US009081334B2

(12) United States Patent
Mochizuki et al.

(10) Patent No.: US 9,081,334 B2
(45) Date of Patent: Jul. 14, 2015

(54) IMAGE FORMING APPARATUS

(75) Inventors: Jun Mochizuki, Abiko (JP); Yasuhito Shirafuji, Kashiwa (JP); Yasushi Takeuchi, Moriya (JP); Kazukiyo Akashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 14/003,353

(22) PCT Filed: Apr. 27, 2012

(86) PCT No.: PCT/JP2012/061804

§ 371 (c)(1),
(2), (4) Date: Sep. 5, 2013

(87) PCT Pub. No.: WO2012/148008

PCT Pub. Date: Nov. 1, 2012

(65) Prior Publication Data

US 2013/0336681 A1 Dec. 19, 2013

(30) Foreign Application Priority Data

Apr. 28, 2011 (JP) ..... 2011-101428

(51) Int. Cl.
*G03G 15/16* (2006.01)
*G03G 15/01* (2006.01)

(52) U.S. Cl.
CPC ..... *G03G 15/1665* (2013.01); *G03G 15/0189* (2013.01); *G03G 15/1675* (2013.01); *G03G 2215/0129* (2013.01); *G03G 2215/1614* (2013.01)

(58) Field of Classification Search
CPC ..... G03G 15/0189; G03G 15/1605; G03G 15/1665; G03G 15/1675; G03G 2215/16; G03G 2215/1619
USPC ..... 399/66, 302, 308, 313, 314
See application file for complete search history.

(56) References Cited

U.S. PATENT DOCUMENTS 7,039,349 B2 * 5/2006 Sohmiya et al. ..... 399/309
2005/0031384 A1 * 2/2005 Sohmiya et al. ..... 399/309

(Continued)

FOREIGN PATENT DOCUMENTS

JP 6-19276 A 1/1994
JP 6-324575 A 11/1994
JP 9-251225 A 9/1997
JP 2001-75372 A 3/2001
JP 2001-166611 A 6/2001

(Continued)

OTHER PUBLICATIONS

International Search Report and Written Opinion mailed Jun. 26, 2012, in International Application No. PCT/JP2012/061804.

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus includes an image carrying member for carrying a toner image; an intermediary member for carrying the toner image transferred from the image carrying member; a first transfer member for transferring the toner image from the intermediary member onto a sheet, the first transfer member having a first resistance and being contacted to the intermediary member; a second transfer member for transferring the toner image from the intermediary member onto the sheet, the second transfer member having a second resistance higher than the first resistance and being contacted to the intermediary member at a position downstream of the first transfer member; and a voltage applying source, connected to both of said first and second transfer members, for applying the same voltage to the first and second transfer members to transfer the toner image onto the sheet.

5 Claims, 3 Drawing Sheets

(56) References Cited

U.S. PATENT DOCUMENTS

| | | | | |
|---|---|---|---|---|
| 2009/0324306 | A1* | 12/2009 | Echigo et al. | 399/314 |
| 2010/0239335 | A1* | 9/2010 | Sawai | 399/319 |
| 2011/0182630 | A1* | 7/2011 | Shirafuji et al. | 399/308 |
| 2012/0251199 | A1* | 10/2012 | Miyazaki | 399/314 |
| 2012/0275808 | A1* | 11/2012 | Mochizuki | 399/66 |
| 2012/0282001 | A1* | 11/2012 | Akashi et al. | 399/308 |

FOREIGN PATENT DOCUMENTS

| | | | |
|---|---|---|---|
| JP | 2003-270974 | A | 9/2003 |
| JP | 2004-29054 | A | 1/2004 |
| JP | 2008-139722 | A | 6/2008 |
| JP | 2010-128235 | A | 6/2010 |
| JP | 2010-243553 | A | 10/2010 |

* cited by examiner

IMAGE FORMING APPARATUS

TECHNICAL FIELD

The present invention relates to an image forming apparatus, such as a copying machine, a printer, etc., which uses an electrophotographic image forming method or an electrostatic recording method.

BACKGROUND ART

It is desired that an image forming apparatus is capable of dealing with various recording mediums. Thus, some image forming apparatuses are provided with a primary transfer station, an intermediary transfer member, and a secondary transfer station. In operation, each apparatus forms a toner image on its image bearing member such as a photosensitive drum, and transfers the toner image onto the intermediary transfer member in the primary transfer station. Then, it transfers the toner image onto a sheet of recording medium from the intermediary transfer member.

Japanese Laid-open Patent Application 2004-29054 discloses an image forming apparatus having an upstream transfer roller and a downstream transfer roller which are provided to reduce the apparatus in the amount of electrical voltage to be applied to transfer a toner image from the intermediary transferring member to a sheet of recording medium, by making the transfer station, that is, the station in which a toner image is transferred from the intermediary transfer member onto a sheet of recording medium, wider in terms of the direction in which a sheet of recording medium is conveyed in the transfer station.

In the case of an image forming apparatus structured like the one disclosed in the abovementioned patent application, it is desired that the amount by which electric current flows through the downstream transferring member is made smaller than the amount by which electric current flows through the upstream transferring member, in order to prevent the problem that a sheet of recording medium fails to properly separate from an intermediary transferring member.

Japanese Laid-open Patent Application 2010-243553 discloses an image forming apparatus having a roller 41 and a plate 66, which are upstream and downstream transferring members, respectively. The roller 41 and plate 66 are used to transfer a toner image onto a sheet of recording medium from the intermediary transferring member of the apparatus. In the case of this image forming apparatus, for the sake of transfer efficiency, the electric current I1, which flows through the roller 41, or the upstream transferring member, is made smaller than the electric current I2, which flows through the plate 66, or the downstream transferring member.

In the case of the image forming apparatus disclosed in Japanese Laid-open Patent Application 2010-243553, however, a transfer power source for flowing electric current through the plate 66 is necessary in addition to the transfer power source for flowing electric current through the roller 41. That is, two transfer power sources are necessary, being therefore likely to lead to cost increase.

DISCLOSURE OF THE INVENTION

Thus, the primary object of the present invention is to provide an image forming apparatus which employs an upstream transferring member and a downstream transferring member to transfer a toner image from its image bearing member onto a sheet of recording medium without causing the sheet of recording medium to fail to properly separate from the primary or secondary image bearing member of the apparatus, and yet, does not require two transfer power sources.

According to an aspect of the present invention, there is provided an image forming apparatus comprising an image carrying member for carrying a toner image; a movable intermediary transfer member for carrying the toner image transferred from said image carrying member; a first transfer member for transferring the toner image from said intermediary transfer member onto a recording material, said first transfer member having a first resistance and being contacted to an outer surface of said intermediary transfer member; a second transfer member for transferring the toner image from said intermediary transfer member onto the recording material, said second transfer member having a second resistance higher than that of the first resistance and being contacted to an outer surface of said intermediary transfer member at a position downstream of said first transfer member with respect to a moving direction of said intermediary transfer member; and voltage applying means, connected to both of said first transfer member and said second transfer member, for applying the same voltage to said first transfer member and to said second transfer member to transfer the toner image onto the recording material.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

<Embodiment 1>

[Overall Structure of Image Forming Apparatus, and Operation of Apparatus]

Figure 1:
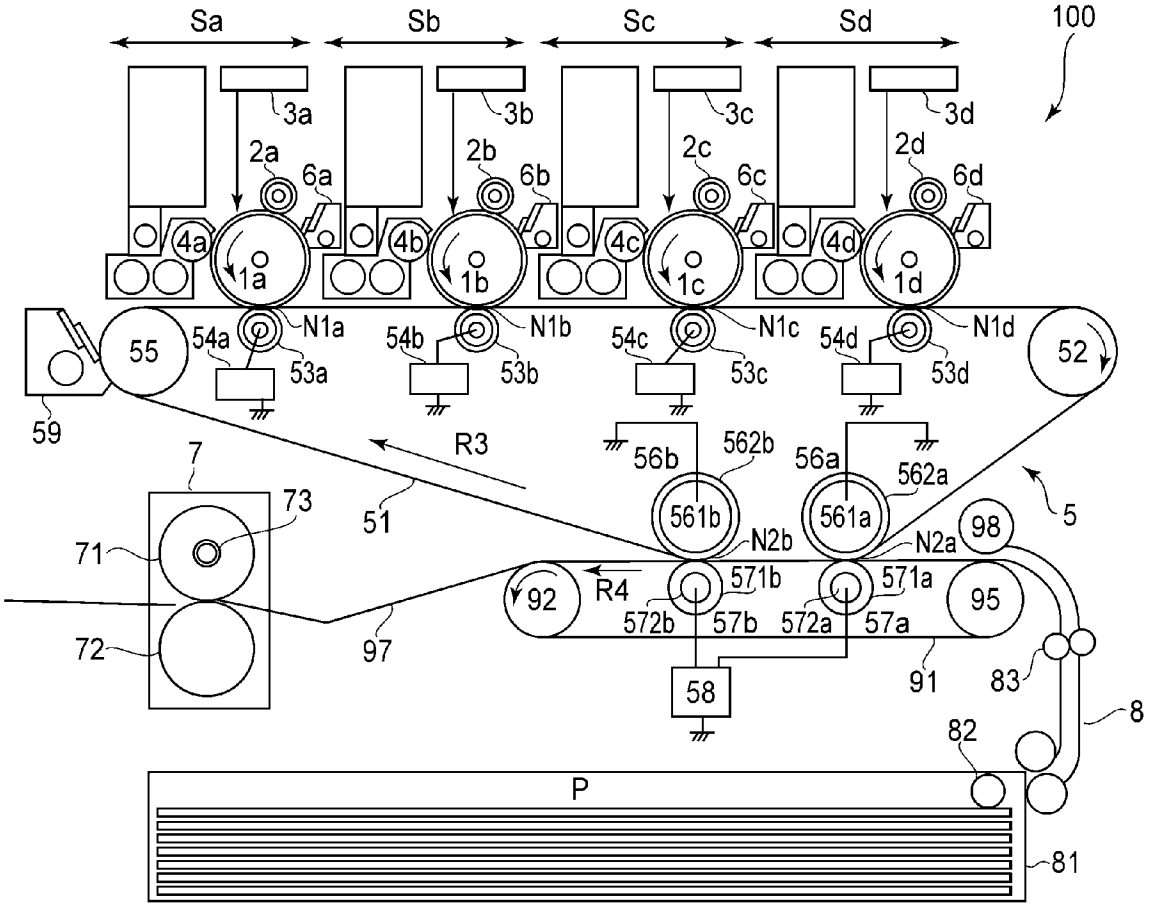
FIG. 1 is a schematic sectional view of the image forming apparatus in the first embodiment of the present invention, and shows the general structure of the apparatus.

First, the overall structure of the image forming apparatus in this embodiment, and the operation of the apparatus, are described. FIG. 1 is a schematic sectional view of the image forming apparatus 100 in this embodiment. It shows the general structure of the apparatus.

Designated by referential codes Sa, Sb, Sc and Sd are processing units, as image formation stations, which form a toner image. The image formation stations Sa, Sb, Sc and Sd form yellow, magenta, cyan and black monochromatic images, respectively. The image formation stations Sa, Sb, Sc and Sd are the same in structure, although they are different in the color of the toner they use. Here, therefore, only the image formation station Sa is described.

The image formation station Sa comprises: a photosensitive drum 1*a* as an image bearing member; a charge roller 2*a* as the charging means for charging the peripheral surface of the photosensitive drum 1*a*; and a laser scanner 3*a* as the exposing means for exposing the charged portion of the peripheral surface of the photosensitive drum 1*a*. Further, it comprises: a developing device 4*a* as the developing means for developing an electrostatic image on the peripheral surface of the photosensitive drum 1*a* into a toner image (image formed of toner); and a transfer roller 53*a* as the primary transferring means for transferring the toner image from the photosensitive drum 1*a* onto an intermediary transfer belt 51. As the photosensitive drum 1*a* is rotated, the peripheral surface of the photosensitive drum 1*a* is charged by the charge roller 2*a*. The charged portion of the peripheral surface of the photosensitive drum 1*a* is exposed by the laser scanner 3*a*, whereby an electrostatic latent image is formed on the photosensitive drum 1*a*; as the output of the laser scanner 3*a* is turned on or off based on the information of the image to be formed, an electrostatic latent image is formed in accordance with the information of the image to be formed. The developing device 4*a* contains yellow toner. To the developing device 4*a*, a preset electrical voltage is applied. Thus, as the electrostatic latent image on the peripheral surface of the photosensitive drum 1*a* is moved through the developing device 4*a*, it is developed into a toner image, that is, a visible image formed of toner; a toner image is formed on the peripheral surface of the photosensitive drum 1*a*. The developing method employed by the image forming apparatus in this embodiment is a reversal development method, that is, a developing method which develops an electrostatic latent image by adhering toner to the exposed points of the electrostatic latent image. The primary transfer roller 53*a* is positioned so that it is pressed against the peripheral surface of the photosensitive drum 1*a* with the presence of the intermediary transfer belt 51 between itself and the peripheral surface of the photosensitive drum 1*a*, forming thereby the primary transfer station where a toner image is transferred onto the intermediary transfer belt 51 from the photosensitive drum 1*a*. To the primary transfer roller 53*a*, the primary transfer voltage is applied by a primary transfer power source 54*a*. As the primary transfer voltage is applied to the primary transfer roller 53*a*, the toner image on the peripheral surface of the photosensitive drum 1*a* transfers onto the intermediary transfer belt 51. The toner remaining on the peripheral surface of the photosensitive drum 1*a* after the transfer of the toner image from the photosensitive drum 1*a* onto the intermediary transfer belt 51 is removed by a drum cleaner 6*a*.

The primary transfer roller 53*a* employed by the image forming apparatus 100 in this embodiment is an elastic roller made up of a metallic core 531 and an electrically conductive urethane sponge layer 532. The metallic core 531 is 8 mm in external diameter. The sponge layer 532 covers the peripheral surface of the metallic core 531, and is 4 mm in thickness. The electrical resistance of the primary transfer roller 53*a* was roughly $10^6$ Ω (23° C./50%RH), which was obtained from the measured amount of the voltage necessary to make 50 μA of constant electric current flow through the metallic core 531 while keeping the primary transfer roller 53*a* pressed upon a grounded metallic roller, with the application of 500 g of pressure, and rotating the primary transfer roller 53*a* at a peripheral velocity of 50 mm/sec. Incidentally, when it is necessary to form a full-color image, yellow, magenta, cyan and black monochromatic toner images are formed in the aforementioned image formation stations Sa, Sb, Sc and Sd, respectively, and are sequentially transferred in layers onto the intermediary transfer belt 51. More specifically, the yellow toner image is transferred onto the intermediary transfer belt 51 in the primary transfer station of the image formation station Sa, and the magenta toner image is transferred onto the intermediary transfer belt 51 so that it is layered onto the yellow toner image on the intermediary transfer belt 51. The cyan toner image is transferred onto the intermediary transfer belt 51 so that it is layered onto the yellow and magenta toner images on the intermediary transfer belt 51, and the black toner image is transferred onto the intermediary transfer belt 51 so that it is layered onto the yellow, magenta and cyan toner images on the intermediary transfer belt 51.

The intermediary transfer belt 51 functions as an intermediary transferring member which bears and conveys the toner images transferred onto the intermediary transfer belt 51 from the photosensitive drums 1*a*, 1*b*, 1*c* and 1*d*. It is positioned so that its outward surface contacts the peripheral surface of the photosensitive drum 1*a*, peripheral surface of the photosensitive drum 1*b*, peripheral surface of the photosensitive drum 1*c*, and peripheral surface of the photosensitive drum 1*d*. It is suspended and kept stretched by four rollers 52, 55, 56*a* and 56*b* as a belt supporting member. It is circularly movable. The intermediary transfer belt 51 employed in this embodiment is a belt formed of polyimide resin. It was $10^{12}$ Ω/□in surface resistivity (measured with use of probe, which is in accordance with JIS-K6911, while applying 100 V for 60 seconds under such condition that is 23° C. in ambient temperature and 50%RH in ambient humidity), and was 80μm in thickness. Needless to say, this embodiment is not intended to limit the present invention in terms of the material for the intermediary transfer belt 51. For example, dielectric resin such as PC (polycarbonate), PET (polyethylene terephthalate), PVDF (polyvinylidene fluoride), etc., may be used as the material for the intermediary transfer belt 51. The aforementioned roller 52 functions as a roller for moving the intermediary transfer belt 51. The rollers 56*a* and 56*b* function as a secondary transfer roller 56 for transferring a toner image onto a sheet of recording medium. The details of the rollers 56*a* and 56*b* will be given later. The intermediary transfer belt 51 is circularly driven by the roller 52, which is functioning as a belt driving means, in the direction indicated by an arrow mark R3 in FIG. 1. As the intermediary transfer belt 51 is circularly moved, the toner image on the intermediary transfer belt 51 is conveyed by the intermediary transfer belt 51 to the second transfer station, in which the toner image is transferred onto a sheet of recording medium.

A transfer belt 91 which bears and conveys a sheet of recording medium is suspended and kept stretched by a pair of rollers 92 and 95. It is circularly movable in the direction indicated by an arrow mark R4 in FIG. 1. The roller 92 functions as a roller for circularly moving the transfer belt 91.

The transfer belt 91 employed in this embodiment is a belt formed of polyimide resin which contains carbon particles. It was $10^{14}$ Ω/□ in surface resistivity (measured with use of probe, which is in accordance with JIS-K6911, while applying 1,000 V for 60 seconds under such condition that is 23° C. in ambient temperature and 50% RH in ambient humidity), and was 80 μm in thickness. Needless to say, this embodiment is not intended to limit the present invention in terms of the material for the transfer belt 91. For example, dielectric resin such as PC (polycarbonate), PET (polyethylene terephthalate), PVDF (polyvinylidene fluoride), etc., may be used as the material for the transfer belt 91.

Stored in layers in a cassette 81 as a recording medium storage are multiple sheets of recording medium. Each sheet of recording medium in the cassette 81 is pulled out of the cassette 81 by a pickup roller 82, and is conveyed toward the transfer belt 91 by a recording medium conveyance roller 83, with such a timing that it reaches the secondary transfer station at the same time as the toner image on the intermediary transfer belt 51. To a recording medium adhering means 98, bias is applied from an unshown bias applying means, so that each sheet of recording medium is electrostatically adhered to the transfer belt 91 before the sheet P is entered into the secondary transfer station. Electrostatically adhering each sheet of recording medium to the recording medium conveyance belt 91 before the sheet is entered into the secondary transfer station ensures that the sheet is satisfactorily conveyed through the secondary transfer station.

In the secondary transfer station, the toner image on the intermediary transfer belt 51 is transferred onto the sheet of recording medium borne by the transfer belt 91 (which hereafter may be referred to as recording medium conveyance belt 91) and conveyed to the secondary transfer station by the recording medium conveyance belt 91. After the transfer of the toner image onto the sheet of recording medium, the sheet of recording medium separates from the recording medium conveyance belt 91, in the adjacencies of the belt driving roller 92. Then, the sheet is conveyed, following a recording medium guide 97, to a fixing device 7 which is a means for fixing a toner image to a sheet of recording medium. Incidentally, the toner remaining on the intermediary transfer belt 51 on the downstream side of the secondary transfer station, that is, the toner which did not transfer from the intermediary transfer belt 51 in the secondary transfer station, is removed from the intermediary transfer belt 51 by a belt cleaner 59 for the intermediary transfer belt 51, and is recovered by the cleaner 59.

The fixing device 7 has a fixation roller 71 and a pressure roller 72, which are rotatable. The pressure roller 72 is rotated while being kept pressed upon the fixation roller 71. There is a heater, such as a halogen lamp, in the hollow of the fixation roller 71. The surface temperature of the fixation roller 71 is adjusted by controlling the voltage applied to this heater 73. As the sheet P of recording medium is conveyed to the fixing device 7, it is conveyed between the fixation roller 71 and pressure roller 72, which are being rotated at a preset speed. While the sheet P is conveyed between the fixation roller 71 and pressure roller 72, the sheet P and the toner image thereon are subjected to heat and pressure (which are kept roughly stable) from both the top and bottom sides of the sheet P. Thus, the unfixed toner image on the sheet P is welded (fixed) to the sheet P, ending thereby the process of forming an image on the sheet P of recording medium.

In order to make the image forming apparatus in this embodiment higher in productivity than an ordinary conventional image forming apparatus, the process speed (peripheral velocity of photosensitive drum 1, peripheral velocity of intermediary transfer belt 51, and recording medium conveyance speed) of the image forming apparatus in this embodiment was set to 700 mm/sec.

[Structure of Secondary Transfer Station]

In this embodiment, the image forming apparatus 100 is provided with the aforementioned rollers 56*a* and 56*b*, which support and keep stretched the intermediary transfer belt 51 by being positioned within the loop which the intermediary transfer belt 51 forms. In terms of the moving direction of the intermediary transfer belt 51, the roller 56*b* is on the downstream side of the roller 56*a*. Further, the image forming apparatus 100 is provided with a pair of rollers 57*a* and 57*b*, which are within the loop which the recording medium conveyance belt 91 forms. In terms of the moving direction of the recording medium conveyance roller 91, the roller 57*b* is on the downstream side of the roller 57*a*. The rollers 56*a*, 56*b*, 57*a*, and 57*b* function as the transferring members for forming the secondary transfer station, in which a toner image is transferred from the intermediary transfer belt 51 onto a sheet P of recording medium.

The outside secondary transfer roller 57*a* (first outside transfer roller), or the upstream outside secondary transfer roller, is positioned so that it opposes the inside secondary transfer roller 56*a* (first inside transfer roller), or the upstream inside secondary transfer roller, with the presence of the recording medium conveyance belt 91 and intermediary transfer belt 51 between itself and the upstream inside secondary transfer roller 56*a*. That is, the upstream outside secondary transfer roller 57*a* presses on the upstream inside secondary transfer roller 56*a*, with the presence of the recording medium conveyance belt 91 and intermediary transfer belt 51 between the two rollers 56*a* and 57*a*, forming thereby a nip (first secondary transfer nip N2*a*). As for the downstream outside secondary transfer roller 57*b* (second outside secondary transfer roller), it is positioned so that it opposes the downstream inside secondary transfer roller 56*b* with the presence of the recording medium conveyance roller 91 and intermediary transfer belt 51 between the two rollers 56*b* and 57*b*. That is, the downstream outside secondary transfer roller 57*b* presses on the downstream inside secondary transfer roller 56*b*, with the presence of the recording medium conveyance belt 91 and intermediary transfer belt 51 between the two rollers 56*a* and 57*a*, forming thereby a nip (second secondary transfer nip N2*b*).

With the formation of multiple (two in this embodiment) secondary transfer nips, it is possible to increase the secondary transfer station in dimension in terms of the recording medium conveyance direction.

In this embodiment, the image forming apparatus 100 is provided with an electric power source 58 for the secondary transfer, which is a means for applying the voltage (for secondary transfer) for transferring a toner image onto a sheet P of recording medium.

Figure 3:
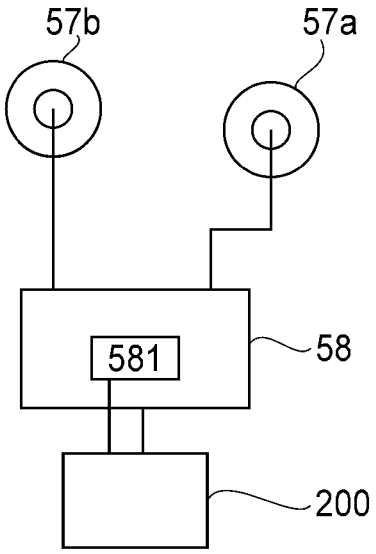
FIG. 3 is a block diagram of the control system for controlling the secondary transfer the image forming apparatus in the first embodiment.

Referring to FIGS. 1 and 3, in this embodiment, the upstream outside secondary transfer roller 57*a* is in connection to the secondary transfer voltage power source 58, whereas the downstream inside secondary transfer roller 56*a* is grounded. The downstream outside secondary transfer roller 57*b* is in connection to the secondary transfer voltage power source 58, whereas the downstream inside secondary transfer roller 56*b* is grounded. That is, the secondary transfer power source 58 is shared by the upstream outside secondary transfer roller 57*a* and downstream outside secondary transfer roller 57*b*. In other words, voltage is applied to both the upstream outside secondary transfer roller 57*a* and downstream outside secondary transfer roller 57*b* by the secondary transfer voltage power source 58. With the application of voltage to both the upstream outside secondary transfer roller 57*a* and downstream outside secondary transfer roller 57*b*, an electric field is formed between the upstream outside secondary transfer roller 57*a* and upstream inside secondary transfer roller 56*a*, and between the downstream outside secondary transfer roller 57*b* and downstream inside secondary transfer roller 56*b*.

That is, the outside secondary transfer rollers 57*a* and 57*b* are rollers as the secondary transferring members for transferring a toner image from the intermediary transfer belt 51 onto a sheet P of recording medium. The inside secondary transfer roller 56*a* and 56*b* are the rollers which oppose the outside secondary transfer rollers 57*a* and 57*b*, respectively.

In order to transfer a toner image onto a sheet P of recording medium, such voltage that is opposite in polarity to the normal polarity (negative) of toner is applied, as the transfer voltage for transferring a toner image onto a sheet of recording medium, to each of the outside secondary transfer rollers 57*a* and 57*b*. The transfer electric field formed by the application of the secondary transfer voltage has such potential that causes normally charged toner on the intermediary transfer belt 51 to transfer from the intermediary transfer belt 51 onto a sheet P of recording medium. The application of the transfer voltage ensures that this transfer electric field is formed at two locations, that is, the first secondary transfer nip N2*a* between the upstream inside secondary transfer roller 56*a* and upstream outside secondary transfer roller 57*a*, and the second secondary transfer nip N2*b* between the downstream inside secondary transfer roller 56*b* and downstream outside secondary transfer roller 57*b*. As a result, two secondary transfer current paths, that is, the current path through the first secondary transfer nip N2*a*, and the current path through the second secondary transfer nip N2*b*, through which the transfer current for transferring a toner image onto a sheet P of recording medium flows, are formed.

Next, the reason why two secondary transfer current paths are formed is described. Some of the conventional image forming apparatus are structured so that a relatively large amount of electric current is necessary to transfer a toner image onto a sheet of recording medium. Further, conventional image forming apparatuses are provided with only a single path through which the current for transferring a toner image onto a sheet of recording medium flows. Thus, if the electric current necessary for transferring a toner image onto a sheet of recording medium is large, the voltage applied in the secondary transfer station has to be high. Thus, it is possible that electrical discharge will occur on the upstream side of the secondary transfer station, and the electrical discharge is likely to disturb the toner image. Therefore, there has been desired such an image forming apparatus structure that does not require transfer voltage to be substantially increased even when a large amount of electric current is necessary to transfer a toner image. In this embodiment, therefore, the image forming apparatus 100 is provided with two paths for the electric current for transferring a toner image, so that the transfer current is divided into two currents. Therefore, the voltage to be applied in the secondary transfer station does not need to be as high as the one to be applied in the secondary transfer station of a conventionally structured image forming apparatus.

In this embodiment, the means employed to convey a sheet P of recording medium through the secondary transfer station is the recording medium conveyance belt 91. In other words, while a sheet P of recording medium is conveyed through the secondary transfer station, it is held by the recording medium conveyance belt 91. Therefore, a sheet P of recording medium is prevented from becoming misaligned with the intermediary transfer belt 51 in the secondary transfer station. Needless to say, this embodiment is not intended to limit the present invention in terms of the means for conveying a sheet P of recording medium through the secondary transfer station. For example, if cost reduction is very important, the image forming apparatus 100 may be structured so that it does not require the recording medium conveyance belt 91.

More concretely, the image forming apparatus 100 may be structured so that it employs one inside secondary transfer roller 56 and two outside secondary transfer rollers 57*a* and 57*b*. In such a case, the inside secondary transfer roller 56 is grounded, and the outside secondary transfer rollers 57*a* and 57*b* are connected to the aforementioned secondary transfer voltage power source 58.

Further, the image forming apparatus 100 may be structured so that it employs three or more outside secondary transfer rollers to form three or more secondary transfer nips.

Figure 4:
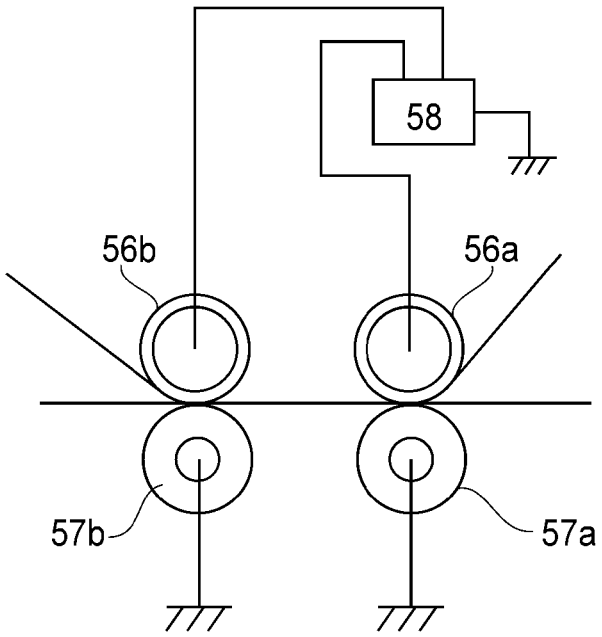
FIG. 4 shows an image transfer mechanism.

Further, the image forming apparatus 100 may be structured as shown in FIG. 4. In this case, the inside secondary transfer rollers 56*a* and 56*b*, which are in contact with the inward surface of the intermediary transfer belt 51, are connected to the secondary transfer voltage power source 58, and the outside secondary transfer rollers 57*a* and 57*b*, which are in contact with the outward surface of the intermediary transfer belt 51, are grounded.

[Voltage Control in Secondary Transfer Station]

In this embodiment, the voltage to be applied by the secondary transfer voltage power source 58 is controlled by the control section 200, based on the basis weight of recording medium inputted by a user. The control section 200 comprises a CPU, ROMs and RAMs. Incidentally, "basis weight" is a term used for the weight of a sheet per unit area ($g/m^2$). It is commonly used to indicate the thickness of recording medium.

In this embodiment, a process called ATVC (Auto Transfer Voltage Control), which is for optimizing the secondary transfer voltage, that is, the voltage for transferring a toner image onto a sheet P of recording medium, is carried out prior to the starting of the secondary transfer while no recording medium is being conveyed through the secondary transfer station.

In the ATVC, multiple constant voltages which are different in magnitude are applied by the secondary transfer voltage power source 58, and the amount of current flowed by each voltage is measured to obtain the relationship between the voltage and the amount of current. Then, the value for the voltage V1 for making the transfer current flow by the target amount It is calculated based on the obtained relationship between the level of each of the multiple voltages and the amount of the corresponding current. During the secondary transfer which follows the voltage adjustment, the sum of the voltage V1, and the voltage V2 necessary to make electric current flow through a sheet P of recording medium, is set as a target voltage t (=V1+V2). Therefore, a proper value is set for the transfer voltage necessary to provide a desired amount of transfer current. During the secondary transfer, the secondary transfer voltage is controlled so that it remains constant. Therefore, even if two sheets P of recording medium which are different in width are conveyed in succession, the toner image transfer onto the second sheet P of recording medium is just as good as that onto the first sheet P.

Figure 2:
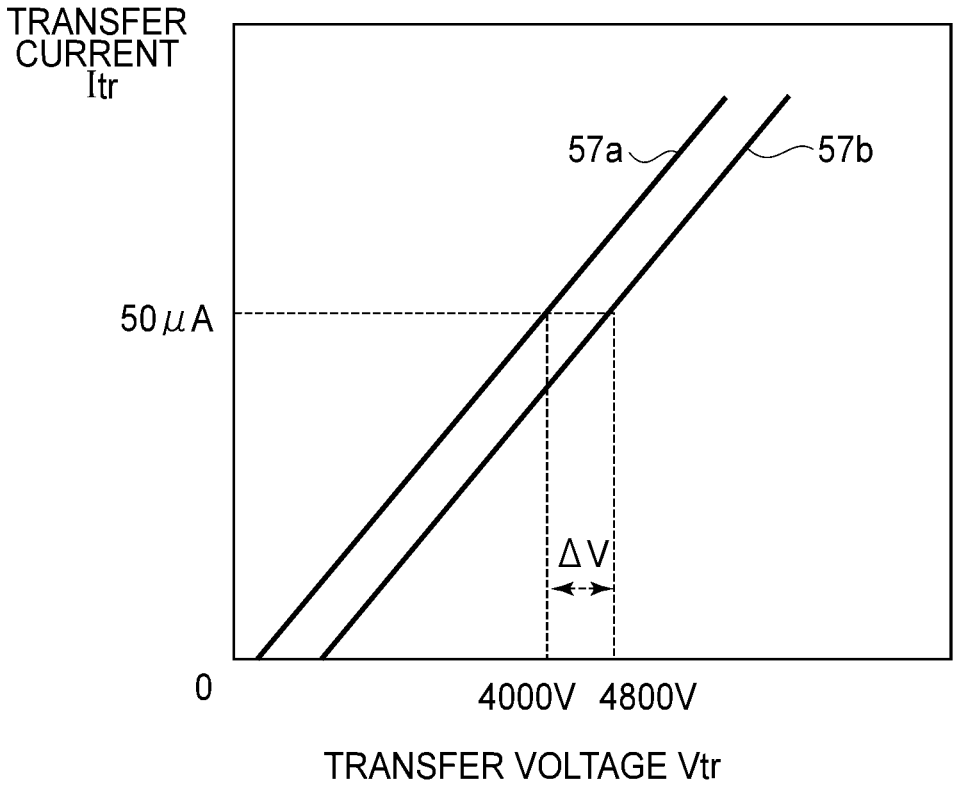
FIG. 2 is a graph which shows the relationship between the transfer current and transfer voltage of the image forming apparatus in the first embodiment.

FIG. 2 shows the relationship between the transfer voltage and transfer current in the secondary transfer station of the image forming apparatus in this embodiment. At the position of the downstream outside secondary transfer roller 57*b*, a sheet P of recording medium and the toner particles thereon still have the electric charge which they received when a toner image was transferred onto the sheet P by the upstream outside secondary transfer roller 57*a*. Therefore, at the position of the downstream outside secondary transfer roller 57*b*, it is difficult for the toner particles (toner image) to be transferred. That is, the voltage necessary to make the transfer current flow at the position of the downstream outside secondary transfer roller 57*b* by the same amount as that in the upstream outside secondary transfer roller 57*a* is higher by ΔV than the transfer voltage applied to the upstream outside secondary transfer roller 57*a*. In this embodiment, this difference ΔV is roughly 800 V. For example, the amount of voltage necessary to make transfer current flow at the position of the upstream outside secondary transfer roller 57*a* is 4,000 V, whereas that at the downstream outside secondary transfer roller 57*b* is 4,800 V.

[Electrical Resistance of Outside Secondary Transfer Rollers 57*a* and 57*b*]

In this embodiment, the image forming apparatus was structured so that the upstream outside secondary transfer 57*a* was lower in electrical resistance than the downstream outside secondary transfer roller 57*b*. More concretely, the downstream outside secondary transfer roller 57*b* was made higher in electrical resistance than the upstream outside secondary transfer roller 57*a*. Thus, this image forming apparatus is substantially greater in the dimension of its area of contact between the intermediary transfer belt 51 and recording medium conveyance belt 91, in which the secondary transfer occur, in terms of the recording medium conveyance direction. Therefore, it can prevent both the phenomenon that a toner image is reduced in quality by the electrical discharge which occurs on the upstream side of the upstream transferring member, and the phenomenon that a sheet P of recording medium fails to properly separate from the downstream transferring member after the secondary transfer.

Each of the inside secondary transfer rollers 56*a* and 56*b* is an elastic roller. The roller 56*a* is made up of a metallic core 561*a* and an elastic layer 562*a*. The metallic core 561*a* is 18 mm in external diameter. The elastic layer 562*a* is formed of electrically conductive solid silicone rubber, and covers virtually the entirety of the peripheral surface of the metallic core 561*a*. The roller 56*b* is made up of a metallic core 561*b* and an elastic layer 562*b*. The metallic core 561*b* is 18 mm in external diameter. The elastic layer 562*b* is formed of electrically conductive solid silicone rubber, and covers virtually the entirety of the peripheral surface of the metallic core 561*b*. The electrical resistance of the inside secondary transfer rollers 56*a* and 56*b*, measured using the same method as that used to measure the electrical resistance of the primary transfer roller 53*a*, was roughly $10^4$ Ω. Needless to say, this embodiment is not intended to limit the present invention in terms of the specifications of these rollers. Incidentally, the electrical resistance of the inside secondary transfer roller is desired to be set to a value which is no higher than 1/100 of that of the outside secondary transfer roller, so that the electrical resistance of the inside secondary transfer roller becomes sufficiently smaller than that of the outside secondary transfer roller.

Each of the outside secondary transfer rollers 57*a* and 57*b* is an elastic roller. The roller 57*a* is made up of a metallic core 571*a* and an elastic layer 572*a*. The metallic core 571*a* is 8 mm in external diameter. The elastic layer 572*a* is formed of electrically conductive EPDM rubber, and covers virtually the entirety of the peripheral surface of the metallic core 571*a*. The roller 57*b* is made up of a metallic core 571*b* and an elastic layer 572*b*. The metallic core 571*b* is 8 mm in external diameter. The elastic layer 572*b* is formed of electrically conductive EPDM rubber, and covers virtually the entirety of the peripheral surface of the metallic core 571*b*.

The electrical resistance of the upstream outside secondary transfer roller 57*a*, measured using the same method as that used to measure the electrical resistance of the primary transfer roller 53*a*, was roughly $1\times10^7$ Ω (which is necessary to flow 50 pA of constant current through secondary transfer nip). The electrical resistance of the downstream outside secondary transfer roller 57*b*, measured using the same method as that used to measure the electrical resistance of the primary transfer roller 53*a*, was roughly $5\times10^7$ Ω (which is necessary to flow 50 pA of constant current through secondary transfer nip).

That is, in a case where the upstream secondary transfer current and downstream secondary transfer current are the same in target value, the image forming apparatus 100 is structured so that the electrical resistance (first resistance) of the upstream outside secondary transfer roller 57*a* is smaller than the electrical resistance (second resistance) of the downstream outside secondary transfer roller 57*b*.

The reason why the image forming apparatus 100 in this embodiment is structured as described above is as follows: If two rollers which are high in electrical resistance and virtually the same in specifications are used as the upstream and downstream outside secondary transfer rollers 57*a* and 57*b*, one for one, the voltage for making the secondary transfer current (current for transferring toner image onto recording medium) has to be high, making it likely for electrical discharge to occur in the adjacencies of the secondary transferring members. Moreover, if electrical discharge occurs in upstream adjacencies of the upstream outside secondary transfer roller 57*a*, it is likely to disturb a toner image. Therefore, the upstream outside secondary transfer roller 57 has to be lower in the voltage to be applied thereto for the secondary transfer. One of the effective means for reducing the upstream outside secondary transfer roller 57*a* in the voltage to be applied thereto for the secondary transfer is to employ a roller which is lower in electrical resistance, as the roller 57*a*.

On the other hand, if two rollers which are low in electrical resistance and virtually the same in specifications are used as the upstream and downstream outside secondary transfer rollers 57*a* and 57*b*, one for one, the following problem occurs: While an area of a sheet P of recording medium, on which a toner image is not present, is moving through the secondary transfer station, the electrical resistance of the secondary transfer station is smaller by the amount of the electrical resistance of toner than while an area of the sheet P, on which a toner image is present, is moving through the secondary transfer station. Therefore, the effects of the electrical resistance of the outside secondary transfer roller is greater while an area of the sheet P, on which a toner image is present, is being moved through the secondary transfer station than while an area of the sheet P, on which no toner image is present, is being moved through the secondary transfer station. If two rollers which are low in electrical resistance and virtually the same in specification are used as the upstream and downstream outside secondary transfer roller 57*a* and 57*b*, the electric current which flows through the secondary transfer station increases as an area of the sheet P having no toner image begins to be conveyed through the secondary transfer station. Thus, the amount by which the leading edge portion, or margin portion, of the sheet P is given electric charge becomes greater, because the leading edge portion, or margin portion, of the sheet P is not the toner image formation area of the sheet P. Therefore, it is likely for the leading edge portion of the sheet P to remain electrostatically adhered to the intermediary transfer belt 51, failing thereby to properly separate from the intermediary transfer belt 51.

Therefore, it has been desired to come up with such a structural arrangement for an image forming apparatus that does not require to increase the voltage to be applied to the upstream outside secondary transfer roller 57*a*, and also, prevents the leading edge portion, that is, margin portion, of a sheet P of recording medium, onto which no toner image is transferred, from increasing in the amount of electric charge given by the downstream outside secondary transfer roller 57*b*.

In this embodiment, therefore, the image forming apparatus 100 is structured so that the electrical resistance (first resistance) of the upstream outside secondary transfer roller 57*a* is lower than that (second resistance) of the downstream outside secondary transfer roller 57*b*. Therefore, not only does this image forming apparatus 100 prevent the occurrence of the image defects attributable to the increase in the voltage to be applied to the upstream secondary transferring member, but also, the phenomenon that the increase in the electric charge given, by the downstream transferring member, to the leading edge portion of a sheet P of recording medium, where no toner image is formed, makes it difficult for the sheet P to properly separate from the intermediary transfer belt 51.

Incidentally, the electrical resistance of the upstream outside secondary transfer roller 57*a* was $1\times10^7$ Ω. Needless to say, this embodiment is not intended to limit the present invention in terms of the electrical resistance of the upstream outside secondary transfer roller 57*a*. As the secondary transfer rollers other than the upstream outside secondary transfer roller 57*a*, it is desired to use a roller which is no less than $1\times10^7$ Ω and no more than $3\times10^7$ Ω.

The reason why the electrical resistance of the upstream outside secondary transfer roller 57*a* is desired to be no more than $3\times10^7$ Ω is that if the electrical resistance of the upstream outside secondary transfer roller 57*a* is higher than $3\times10^7$ Ω the transfer voltage has to be increased, which in turn creates such an image formation problem as scattering of toner. The reason why the electrical resistance of the upstream outside secondary transfer roller 57*a* is desired to be no less than $1\times10^7$ Ω is that if the transfer roller 57*a* is low in electrical resistance, it is possible that the electrical current which flows from the secondary transfer voltage power source will exceed an allowable level.

The electrical resistance of the roller used as the downstream outside secondary transfer roller 57*b* in this embodiment is $5\times10^7$ Ω. Needless to say, this embodiment is not intended to limit the present invention in terms of the electrical resistance of the downstream outside secondary transfer roller 57*b*. That is, the electrical resistance of the roller to be used as the downstream outside secondary transfer roller 57*b* has only to be no less than $3\times10^7$ Ω, and no more than $1\times10^8$ Ω, for the following reason.

The reason why the electrical resistance of the downstream outside secondary transfer roller 57*b* is desired to be no less than $3\times10^7$ Ω is that if it is less than $3\times10^7$ Ω, the amount by which electric current flows through the leading edge portion of a sheet P of recording medium, is likely to be large enough to make it difficult for the sheet P to properly separate from the intermediary transfer belt 51. The reason why the electrical resistance of the downstream outside secondary transfer roller 57*b* is desired to be no more than $1\times10^8$ Ω is that if it is more than $1\times10^8$ Ω, the transfer voltage will have to be large enough to trigger electrical discharge, which in turn will cause the image forming apparatus to output images which suffer from the defects attributable to the electrical discharge.

<Embodiment 2>

Next, the second embodiment of the present invention is described. The substantial portions of the second embodiment are the same as the counterparts of the first embodiment. Therefore, these portions are not going to be described here.

In this embodiment, the secondary transfer voltage power source 58 is in connection to the inside secondary transfer rollers 56*a* and 56*b*, and the outside secondary transfer rollers 57*a* and 57*b* are grounded. The secondary transfer voltage to be applied to the inside secondary transfer roller 56*a* and 56*b* to transfer a toner image is the same in polarity as toner.

The image forming apparatus in this embodiment is structured so that the upstream inside secondary transfer roller 56*a*, which is in connection to the secondary transfer voltage power source 58, becomes the first electrical resistance, and the downstream inside secondary transfer roller 56*b*, which is in connection to the secondary transfer voltage power source 58, becomes the second electrical resistance, which is higher than the first electrical resistance. Therefore, not only is it possible to prevent the image forming apparatus from outputting images which suffer from the defects attributable to the increase in the voltage to be applied to the upstream secondary transferring member, but also, to prevent the problem that a large amount of electrical charge is given by the downstream transferring member to the leading edge portion of a sheet P of recording medium, where no toner image is formed, and this large amount of electric charge causes the sheet P to unsatisfactorily separate from the intermediary transfer belt 51.

Each of the outside secondary transfer rollers 57*a* and 57*b* is an elastic roller. The roller 57*a* is made up of a metallic core 571*a* and an elastic sponge layer 572*a*. The metallic core 571*a* is 8 mm in external diameter. The elastic sponge layer 572*a* is 4 mm in thickness and is formed of electrically conductive EPDM rubber. It covers virtually the entirety of the peripheral surface of the metallic core 571*a*. The roller 57*b* is made up of a metallic core 571*b* and an elastic sponge layer 572*b*. The metallic core 571*b* is 8 mm in external diameter. The elastic sponge layer 572*b* is 4 mm in thickness, and is formed of electrically conductive EPDM rubber. It covers virtually the entirety of the peripheral surface of the metallic core 571*b*. The outside secondary transfer rollers 57*a* and 57*b* are roughly $10^4$ Ω in electrical resistance, which was measured with the same method as the one used to measure the electrical resistance of the primary transfer roller 53*a*. Needless to say, this embodiment is not intended to limit the present invention in terms of the electrical resistance of the outside secondary transfer rollers 57*a* and 57*b*.

The inside secondary transfer roller 56*a* is an elastic roller. It is made up of a metallic core 561*a* and an elastic sponge layer 562*a*. The metallic core 561*a* is 18 mm in external diameter. The elastic sponge layer 562*a* is 2 mm in thickness and is formed of electrically conductive solid silicone rubber. It covers virtually the entirety of the peripheral surface of the metallic core 561*a*. The inside secondary transfer roller 56*b* is made up of a metallic core 561*b* and an elastic layer 562*b*. The metallic core 561*b* is 18 mm in external diameter. The elastic layer 562*b* is 2 mm in thickness, and is formed of electrically conductive solid silicone rubber. It covers virtually the entirety of the peripheral surface of the metallic core 561*b*.

As the upstream outside secondary roller 57*a* in this embodiment, a roller which was roughly $1\times10^7$ Ω in electrical resistance, which was measured with the use of the same method as that used to measure the electrical resistance of the primary transfer roller 53*a*, while flowing 50 μm of constant current, was used. As the downstream outside secondary transfer roller 57*b*, a roller which was roughly $5\times10^7$ Ω, which was measured with the use of the same method as that used to measure the electrical resistance of the primary transfer roller 53*a*, while flowing 50 μm of constant current, was used.

The inside secondary transfer rollers 56*a* and 56*b* are in connection to the power source 58, and the outside secondary transfer rollers 57*a* and 57*b* are grounded. However, this embodiment is not intended to limit the present invention in scope in terms of the connection and grounding of the secondary transfer rollers.

For example, the image forming apparatus may be provided with two inside secondary transfer rollers 56*a* and 56*b*, and one outside secondary transfer roller 57. In such a case, the inside secondary transfer rollers 56*a* and 57*b* are connected to the power source 58, and the outside secondary transfer roller 57 is grounded.

Further, the image forming apparatus may be provided with three or more inside secondary transfer rollers to form three or more secondary transfer nips.

While the invention has been described with reference to the structures disclosed herein, it is not confined to the details set forth, and this application is intended to cover such modifications or changes as may come within the purposes of the improvements or the scope of the following claims.

INDUSTRIAL APPLICABILITY

According to the present invention, there is provided an image forming apparatus which employs an upstream transferring member and a downstream transferring member to transfer a toner image from its image bearing member onto a sheet of recording medium without causing the sheet of recording medium to fail to properly separate from the primary or secondary image bearing member of the apparatus, and yet, does not require two transfer power sources.

The invention claimed is:

1. An image forming apparatus comprising:

an image carrying member for carrying a toner image;

a movable intermediary transfer member for carrying the toner image transferred from said image carrying member;

a first transfer member for transferring the toner image from said intermediary transfer member onto a recording material, said first transfer member having a first resistance and being contacted to an outer surface of said intermediary transfer member;

a second transfer member for transferring the toner image from said intermediary transfer member onto the recording material, said second transfer member having a second resistance higher than the first resistance and being contacted to the outer surface of said intermediary transfer member at a position downstream of said first transfer member with respect to a moving direction of said intermediary transfer member; and voltage applying means, connected to both of said first transfer member and said second transfer member, for applying the same voltage to said first transfer member and to said second transfer member to transfer the toner image onto the recording material.

2. An apparatus according to claim 1, further comprising a first grounded member opposed to said first transfer member through said intermediary transfer member, and a second grounded member opposed to said second transfer member through said intermediary transfer member.

3. An apparatus according to claim 2, wherein said first transfer member is a roller, said second transfer member is a roller, said first grounded member is a roller, and said second grounded member is a roller.

4. An apparatus according to claim 1, wherein the first resistance is not less than $1\times10^7$ Ω and not more than $3\times10^7$ Ω and the second resistance is not less than $3\times10^7$ Ω and not more than $1\times10^8$ Ω.

5. An apparatus according to claim 1, wherein said voltage applying means applies the voltage which is constant-voltage-controlled.

* * * * *